US007651082B2

(12) United States Patent
Hendrix et al.

(10) Patent No.: US 7,651,082 B2
(45) Date of Patent: Jan. 26, 2010

(54) MEDIA STACK STOP

(75) Inventors: Steven W. Hendrix, Jamul, CA (US); Long C. Doan, San Diego, CA (US); Steven A. Batson, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 113 days.

(21) Appl. No.: 11/740,146

(22) Filed: Apr. 25, 2007

(65) Prior Publication Data

US 2008/0265490 A1 Oct. 30, 2008

(51) Int. Cl.
*B65H 3/52* (2006.01)
*B65H 1/00* (2006.01)

(52) U.S. Cl. ..... 271/121; 271/145; 271/124

(58) Field of Classification Search ..... 271/121, 271/122, 118, 117, 119, 3.15, 152, 153, 258.01, 271/265.01

See application file for complete search history.

(56) References Cited

U.S. PATENT DOCUMENTS

| | | | | |
|---|---|---|---|---|
| 2,357,816 | A | 9/1944 | Flanigan | |
| 3,949,979 | A | 4/1976 | Taylor et al. | |
| 3,957,366 | A | 5/1976 | Taylor et al. | |
| 3,966,189 | A | 6/1976 | Taylor et al. | |
| 4,478,313 | A | 10/1984 | Wakase | |
| 4,697,911 | A * | 10/1987 | Kajita et al. | 399/402 |
| 5,470,052 | A * | 11/1995 | Asakawa et al. | 271/118 |
| 5,740,696 | A | 4/1998 | Jean et al. | |
| 6,431,541 | B2 * | 8/2002 | Kuo et al. | 271/118 |
| 6,581,924 | B2 | 6/2003 | Gaarder et al. | |
| 6,651,973 | B2 | 11/2003 | Gaarder et al. | |
| 6,666,446 | B2 | 12/2003 | Gaarder et al. | |
| 6,764,072 | B2 * | 7/2004 | Gaarder | 271/121 |
| 6,792,241 | B2 * | 9/2004 | Nakagawa et al. | 399/367 |
| 6,874,776 | B2 | 4/2005 | Gaarder et al. | |
| 6,969,058 | B2 | 11/2005 | Gaarder et al. | |
| 7,255,339 | B2 * | 8/2007 | Hung et al. | 271/122 |
| 7,320,462 | B2 * | 1/2008 | Takamatsu | 271/3.14 |
| 2002/0074711 | A1 * | 6/2002 | Higaki | 271/117 |
| 2002/0096819 | A1 * | 7/2002 | Fukasawa et al. | 271/121 |
| 2003/0090053 | A1 * | 5/2003 | Hsiao et al. | 271/118 |
| 2004/0188918 | A1 * | 9/2004 | Morimoto et al. | 271/121 |
| 2004/0251592 | A1 * | 12/2004 | Ruhe et al. | 271/109 |
| 2006/0049572 | A1 * | 3/2006 | Miyazawa | 271/121 |
| 2007/0001374 | A1 * | 1/2007 | Lee | 271/117 |
| 2008/0054549 | A1 * | 3/2008 | Lee | 271/117 |
| 2008/0246207 | A1 * | 10/2008 | Bridges et al. | 271/3.13 |

* cited by examiner

*Primary Examiner*—Patrick H Mackey
*Assistant Examiner*—Patrick Cicchino

(57) ABSTRACT

Various apparatus and methods relating to a media stack stop are disclosed.

21 Claims, 10 Drawing Sheets

MEDIA STACK STOP

CROSS-REFERENCE TO RELATED PATENT APPLICATIONS

The present application is related to co-pending U.S. patent application Ser. No. 11/740,176 filed on the same day here with by Steven W. Hendrix, Long C. Doan and Mark A. Overton and DOCUMENT TRANSPORT, the full disclosure which is hereby incorporated by reference.

BACKGROUND

Document feeders sometimes include a gate to limit insertion of a stack of media into the document feeder. Moving the gate to feed sheets from the stack may involve complex systems and complex operational steps.

DETAILED DESCRIPTION OF THE EXAMPLE EMBODIMENTS

Figure 1:
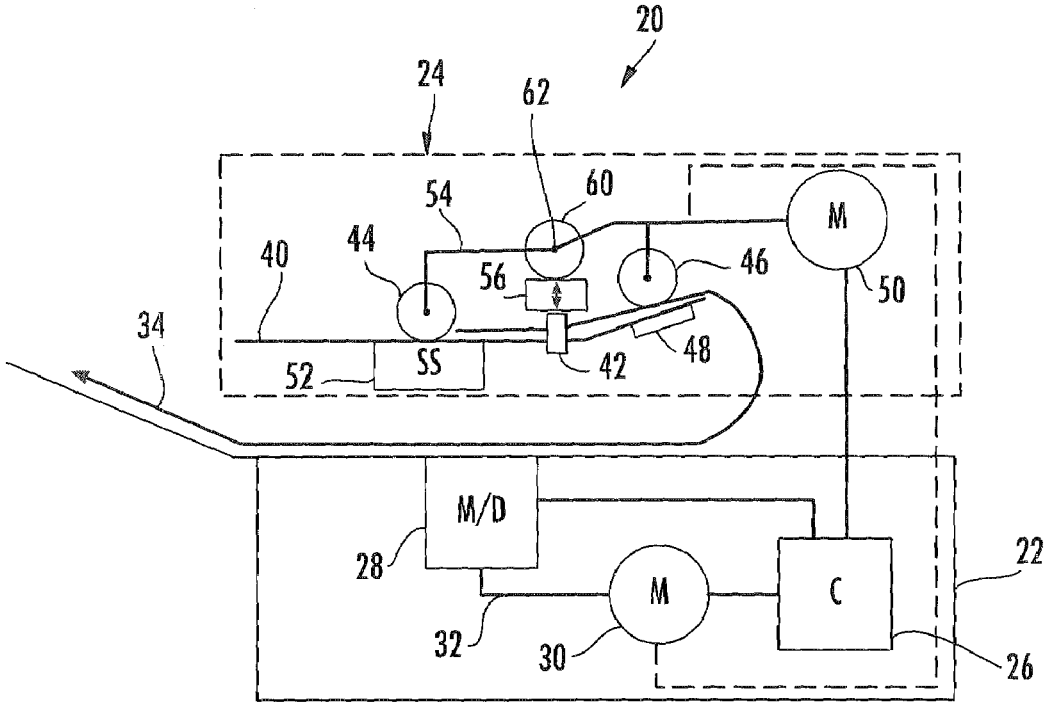
FIG. 1 is a schematic diagram of an apparatus including a document feeder prior to loading of media according to an example embodiment.

FIG. 1 schematically illustrates apparatus 20 according to an example embodiment. Apparatus 20 includes media interaction system 22, document feeder 24 and controller 26. As will be described hereafter, document feeder 24 facilitates feeding of sheets of media from a stack of media to media interaction system 22 in a less complex manner. For example, document feeder 24 controls positioning of a media stack stop or gate without the use of a sensor or without reversing a motor.

Media interaction system 22 comprises a system of components configured to interact with sheets of media fed and supplied by document feeder 24. Media interaction system 22 includes media interaction device 28, motor 30 and transmission 32. Media interaction device 28 comprises device configured to interact with sheets supplied by document feeder 24 in a way so as to either modify such sheets or to sense or read information or data from such sheets.

In one embodiment, media interaction device 28 may comprise one or more print heads configured to deposit ink or other fluid upon a surface of sheets supplied by document feeder 24. For example, in one embodiment, media interaction device 28 may comprise a pen or cartridge having drop-on-demand inkjet nozzles configured to eject fluid onto a surface of sheets provided by document feeder 24, wherein the pen or cartridge is scanned or moved across the sheet being printed upon. In another embodiment, media interaction device 28 may comprise a page-wide-array of print heads, wherein the array of print heads remain stationary while printing across a dimension of the sheets supplied by document feeder 24. In other embodiments, media interaction device 28 may comprise other mechanisms configured to print or form an image upon a sheet supplied by document feeder 24.

In yet other embodiments media interaction device 28 may be configured to sense or read images or data from a sheet supplied by document feeder 24. For example, media interaction device may comprise a scanner bar configured to reflect light off of a face of a sheet supplied by document feeder 24 and to sense the reflected light so as to sense images or other information upon the face of the sheet. In one embodiment, media interaction device 28 may be provided as part of a scanner bed, wherein document feeder 24 feeds documents across media interaction device 28. In such an embodiment, media interaction device 28 may additionally be configured to be scanned or moved across a dimension of a sheet to provide an option of flatbed scanning. In still other embodiments, media interaction device 28 may be configured to perform other operations upon sheets supplied by document feeder 24, including, but not limited to, creasing, folding, stapling or other treatments.

Motor 30 comprises a source of torque operably coupled to media interaction device 28 by a transmission 32 (schematically shown) configured to utilize the torque supplied by motor 30 to linearly move media interaction device 28 across one or more dimensions of a sheet of media supplied by document feeder 24. Transmission 32 may include a rack and pinion gear arrangement, wherein media interaction device 28 is supported by a carriage connected to pinion gear that moves along a rack gear. Alternatively, transmission 32 may include endless belt, wherein media interaction device 28 is connected to an intermediate portion of the belt such that movement of the belt linearly moves media interaction device 28. In yet other embodiments, transmission 32 may have other configurations.

Motor 30 and transmission 32 cooperate to move media interaction device 28 such that media interaction device 28 may interact with a larger surface area of a document supplied by document feeder 24. For example, in embodiments where media interaction device 28 comprises one or more print heads, motor 30 and transmission 32 may be configured to supply torque to move the one or more print heads across the sheet to print across a dimension of the sheet. In embodiments where media interaction device 28 comprises a scanner configured to sense or read information from a sheet, motor 30 may supply torque so as to linearly move the image sensor across a dimension of a sheet supplied by document feeder 24 to sense information while the sheet is substantially stationary, such as with flatbed scanning. In other embodiments where media interaction device 28 is substantially stationary as it interacts with the media, such as when a page-wide-array of print heads is employed or such as when document feeder 24 moves the sheet across media interaction device 28 and a flatbed scanning option is not provided, motor 30 and transmission 32 may be omitted.

Document feeder 24 supplies individual sheets from a stack of sheets to media interaction device 28 or to a transport configured to transport the individual sheets to media interaction device 28. In the example embodiment illustrated, document feeder 24 picks individual sheets from a stack and move such individual sheets along a media path 34 across media interaction device 28. Media path 34 is defined by one or more structures, such as covers, idling rollers, driven rollers and the like, configured to guide and direct such sheets as they are being moved. In the particular example illustrated, media path 34 downwardly turns prior to crossing media interaction device 28. In other embodiments, media path 34 may alternatively upwardly turn prior to crossing media interaction device 28 or may omit such turns.

In one embodiment, document feeder 24 is configured as a self-contained separate module or unit connectable to a housing containing media interaction device 28. For example, in one embodiment where media interaction device 28 is provided as part of scanner bed document feeder 24 may be provided as part of a lid configured to cover the scanner bed. In another embodiment, document feeder 24 may be integrally incorporated as part of an electronic device which includes media interaction device 28.

Document feeder 24 includes input tray 40, media stack stop 42, pick tire 44, separation roller 46, separation surface 48, motor 50, slip surface 52, power train 54 and media stack stop control 56. Input tray 40 comprises a platform or surface upon which a stack of sheets may be loaded. Although input tray 40 is illustrated as extending in a generally horizontal plane, in other embodiments, input tray 40 may have other orientations. For example, input tray 40 may alternatively extend in an inclined plane.

Figure 2:
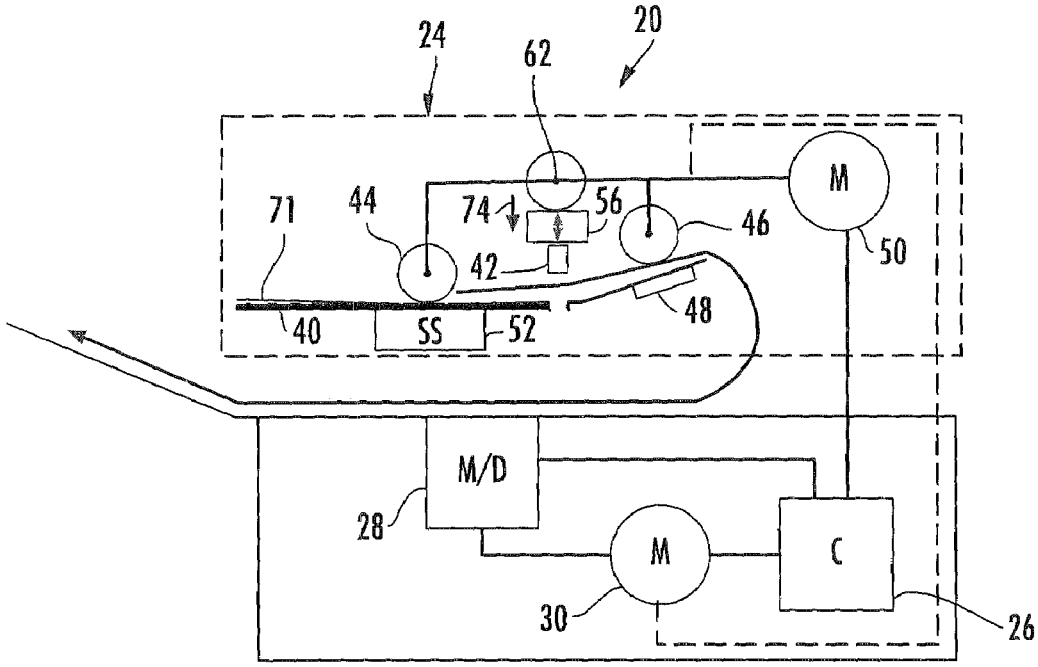
FIG. 2 is a schematic diagram of the apparatus of FIG. 1 illustrating the document feeder loaded with media according to an example embodiment.

Media stack stop 42 comprises a gate, wall, fence, tab, blade, prong or other structure configured to move between a blocking or intercepting position (shown in FIG. 1) and a withdrawn position (shown in FIG. 2). In the blocking or intercepting position, media stack stop 42 extends across and intercepts media path 34. As a result, media stack stop 42 limits an extent to which one or more sheets may be loaded onto tray 40 and moved along media path 34. Media stack stop 42 provides a surface against which leading edges of the sheets of the stack upon tray 40 may abut. Media stack stop 42 assists in controlling positioning of the stack of sheets. Such control over the positioning of sheets loaded onto tray 40 enhances performance up document feeder 24 by reducing the likelihood of mispicks (where a sheet is not separated and fed from the stack) and multipicks (where multiple sheets are concurrently separated and fed from the stack).

In the particular example illustrated, media stack stop 42 provides a surface against which leading edges of the loaded stack abut that is substantially perpendicular to the surface of tray 40. In the example illustrated, media stack stop 42 projects from above and below the upper surface of tray 40 went in the intercepting position shown in FIG. 1. As a result, media stack stop 42 may more reliably engage and intercept the loaded sheets. In other embodiments, however, media stack stop 42 may have other configurations. For example, in other embodiments, media stack stop 42 may provide a surface that abuts leading edges of the stack that is sloped or ramped. In other embodiments, media stack stop 42 may alternatively abut against a top surface of input tray 40. Although media stack stop 42 is illustrated as being spaced above input tray 40 when in the withdrawn position, in other embodiments, a top of media stack stop 42 may alternatively be at or below the surface of media input tray 40 when in the withdrawn position.

Pick tire 44 comprises a member configured to be rotationally driven while in frictional engagement with a topmost sheet of a stack of sheets loaded upon input tray 40 less to drive the topmost sheet further alone media path 34. Pick tire 44 is movably supported relative to input tray 40 to accommodate different stack sizes. In one embodiment, pick tire 44 is pivotably supported relative to input tray 40 to pivot between different positions and spacings with respect to input tray 40. In other embodiments, pick tire 44 may be movable in other fashions.

Separation roller 46 comprises a roller configured to be rotationally driven while in frictional engagement with a topmost sheet that has been driven by pick tire 44 along media path 34. The separation roller 46 continues to drive the sheet along media path 34 to other driven rollers which continue to move the sheet along media path 34.

Separation surface 48 comprises an area generally opposite to separation roller 46 that is configured to inhibit further movement along media path 34 of sheets that may be adhering to a topmost sheet and that are not in contact with separation roller 46. Separation surface 48 assists in reducing the likelihood of multiple sheets being concurrently moved along media path 34. In one embodiment, separation surface 48 comprises a surface having a relatively high coefficient of friction with such sheets. For example, in one embodiment, separation surface 48 may comprise a pad of high friction material such as rubber or cork. Although not illustrated, in other embodiments, additional separation surfaces having teeth or high friction surfaces may be provided prior to separation roller 46, between pick tire 44 and separation roller 46. In some embodiments, separation surface 48 may be omitted.

Motor 50 comprises a source of torque for power train 54 for driving pick tire 44 and separation roller 46. In other embodiments, separate motors may be provided for driving pick tire 44 and separation roller 46. As indicated in broken lines, in another embodiment, motor 50 may be omitted where motor 30 is also operably connected to pick tire 44 and separation roller 46 so as to supply torque to power train 54 for driving pick tire 44 and separation roller 46.

As will be described hereafter, slip surface 52, power train 54 and media stack stop control 56 cooperate to control the positioning of media stack stop 42, either (1) by physically moving stack stop 42 between the intercepting position or the withdrawn position or (2) by impeding movement of media stack stop 42 from the intercepting position to the withdrawn position or from the withdrawn position to the intercepting position. Slip surface 52, power train 54 and media stack stop control 56 control the positioning of media stack stop 42 based upon whether one or more sheets are loaded onto input tray 40. Slip surface 52, power train 54 and media stack stop control 56 control the positioning of media stack stop 42 based upon the different forces experienced by power train 54 when one or more sheets are loaded onto tray 40 between pick tire 44 and slip surface 52 as compared to when no sheets are loaded onto input tray 40 and pick tire 44 is in direct contact with slip surface 52 or is out of contact with any opposing surface.

According one embodiment, such control by slip surface 52, power train 54 and media stack stop control 56 is achieved without employing sensors for sensing the presence or absence of the sheet upon input tray 40. In the particular example illustrated, such control is achieved without using an additional torque source or motor for moving media stack stop 42. In the particular example illustrated, such control is achieved without motor 50 having to be reversed and with motor 50 being driven in the same direction as used to drive pick tire 44 and separation roller 46. Consequently, document feeder 24 is a less complex.

Slip surface 52 comprises a surface opposite to pick tire 44 that when in contact with pick tire 44 (i.e. in the absence of sheets upon tray 40) that impedes rotation of pick tire 44 to a lesser extent as compared to when sheets are present upon tray 40 and overlie slip surface 52 so as to be in contact with pick tire 44. Slip surface 52 enlarges or exaggerates any differences in the forces experienced by power train 54 when pick tire 44 is a rotationally driven against a sheet as compared to when pick tire 44 is not in contact with a sheet. This enlarged difference between the forces experienced by power train 54 when the sheet is present as compared to when a sheet is not present upon tray 40 is used to automatically control positioning of media stack stop 42.

In one embodiment, slip surface 52 comprises an idling roller rotationally supported opposite to pick tire 44. In another embodiment, slip surface 52 may comprise a pad of low friction material having a coefficient of friction less than that of sheets to be loaded onto tray 40. For example, slip surface 52 may comprise a pad of polytetraflouroethylene (TEFLON). In still other embodiments where he surface of tray 40 opposite to pick tire 44 itself as a coefficient of friction sufficiently different than that of the coefficient of friction with pick tire 44, slip surface 52 may be omitted.

Power train 54 comprises an arrangement of components or members configured to transmit torque from motor 50 (or motor 30) to pick tire 44 and separation roller 46 so as to rotationally drive pick tire 44 and separation roller 46. Power train 54 is further configured such that the forces experienced by power train 54 are used to control positioning of media stack stop 42. In particular, power train 54 includes a rotational member 60 that transmits motion or torque to pick tire 44. Rotational member 60 is supported so as to translate when sufficient forces are experienced by power train 54 depending upon whether pick tire 44 is contacting a sheet upon tray 40 or whether pick tire 44 is experiencing much less resistance as a result of contacting slip surface 52. This translation is used to control positioning of media stack stop 42.

For purposes of this disclosure, the term "translating" means that a rotational member (such as rotational member 60) is moving with respect to its own rotational axis (such as axis 62). Such translation excludes rotation of the rotational member about its own rotational axis. Such translation may be linear or may be arcuate. For example, such translation may involve a rotational member sliding along a linear or curved path or pivoting about an axis distinct from the rotational axis of the rotational member.

Rotational member 60 is operably coupled to media stack stop control 56 and media stack stop 42 so as to control positioning of media stack stop 42. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

Media stack stop control 56 comprises one or more members operably coupled between rotational member 60 and media stack stop 42 so as to control positioning of media stack stop 42 based upon positioning of rotational member 60. According to one embodiment, media stack stop control 56 comprises an arrangement of one or more components physically connecting rotational member 60 to media stack stop 42. As a result, translation of member 60 moves media stack stop 42 between the intercepting position and the withdrawn position. Such movement of media stack stop 42 may be proportional to the movement of rotational member 60 or may be larger or smaller using appropriately configured intermediate structures. Such movement of media stack stop 42 may be in the same direction or in an opposite direction as that of rotational member 60. For example, in one embodiment, rotational member 60 may be connected to media stack stop 42 by intermediate pivoting lever, wherein downward movement or translation of rotational member 60 results in media stack stop 42 being lifted and upward translation of rotational member 60 results in media stack stop 42 being lowered.

According to another embodiment, media stack stop control 156 operably couples rotational member 60 to media stack stop 42 such that translation of rotational member 60 moves another intermediate member into or out of engagement with media stack stop 42 so as to retain media stack stop 42 in a selected position or permit movement of media stack stop 42 to a selected position. For example, in one embodiment, media stack stop control 156 includes a lock to retain media stack stop 42 in the intercepting position. In such an embodiment, power train 54 may be configured such that translation of rotational member 60 moves the lock to an unlocked state with respect to media stack stop 42, permitting media stack stop 42 to move out of the intercepting position to the withdrawn position such as when a sheet or stack of sheets is pressed against media stack stop.

According to one embodiment, power train 54 includes a gear train, wherein rotational member 60 comprises a gear of the gear train. In other embodiments, power train 54 may comprise other torque transmitting arrangements such as a belt and pulley arrangement or a chain and sprocket arrangement for transmitting torque. When power train 54 comprises a belt and pulley arrangement, rotational member 60 may comprise a pulley. When power train 54 comprises a chain and sprocket arrangement, rotational member 60 may comprise a sprocket. Regardless of the particular nature of power train 54, rotational member 60 is configured to translate in response to power train 54 experiencing forces which are the result of pick tire 44 encountering different levels of resistance depending upon whether pick tire 44 is in contact with a sheet upon tray 40 or is in contact with slip surface 52.

Controller 26 comprises one or more processing units configured to generate control signals directing the operation of at least motors 30 and 50. Controller 26 may additionally generate control signals directing the operation of media interaction device 28. In particular embodiments where media interaction device 28 is a sensing device, such as a scanner bar, controller 26 may also receive signals from media interaction device 28 and may generate electronic files representing the images or data sensed upon a sheet supplied by document feeder 24.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 26 may be embodied as part of one or more application-specific integrated circuits (ASICs). Unless otherwise specifically noted, the controller is not limited to any specific combination of hardware circuitry and software, nor to any particular source for the instructions executed by the processing unit.

FIGS. 1 and 2 illustrate operation of document feeder 24 and apparatus 20. FIG. 1 illustrates apparatus 20 prior to loading of a sheet or stack of sheets onto input tray 40. In the absence at any sheets having been loaded onto input tray 40, pick tire 44 directly contacts slip surface 52. As a result, pick tire 44 and power train 54 (driving pick tire 44) experience less resistance as compared to when pick tire 44 is in engagement with a sheet upon in input tray 40. As a result, rotational member 60 is in an at-rest position and media stack stop 42 is in the intercepting position. In one embodiment, media stack stop 42 is biased towards the intercepting position by gravity and cannot be moved from the intercepting position when rotational member 60 is in the at-rest position. In another embodiment, media stack stop 42 is biased toward the intercepting position by gravity and is retained in the intercepting position by a lock when rotational member 60 is in the at-rest position. The positioning of media stack stop 42 in the intercepting position does not change even when motor 50 is supplying torque so as to drive pick tire 44.

FIG. 2 illustrates apparatus 20 after a stack 71 of sheets has been loaded onto tray 40. Such loading occurs when pick tire 44 is not being driven. In one embodiment, pick tire 44 is lightly sprung and moves upward upon insertion of a stack. During such insertion, a clutch or similar mechanism (not shown) permits the tire 44 to rotate along the top sheet. In other embodiments, pick tire 44 has been moved to a position spaced from tray 40 to permit stack 71 to be loaded without pick tire 44 contacting the loaded stack 71. During loading, as described above with respect to FIG. 1, media stack stop 42 is in the intercepting position. As a result, stack 71 may be loaded and inserted by a person until the leading edge of stack 71 abuts or contact media stack stop 42. Media stack stop 42 provides a person loading stack 71 with a positive indication that stack 71 has been loaded and sufficiently inserted into document feeder 24. Media stack stop 42 further prevents insertion of stack 71 too far into document feeder 24 which could potentially resulted subsequent misfeeding by document feeder 24. After loading of stack 71, pick tire 44 is lowered or otherwise moved into engagement with a topmost sheet of the stack 71.

FIG. 2 illustrates the initiation of torque being supplied to power train 54 and pick tire 44 after stack 71 has been loaded. Because stack 71 has been loaded, pick tire 44 engages a top most sheet of stack 71 which offers a greater resistance to rotation of pick tire 44 as compared to slip surface 52. This greater resistance causes greater torque to be transmitted across power train 54 when pick tire is driven. The additional torque transmitted across power train 54 is sufficient to translate rotational member 60 schematically represented by arrow 74. Such translation actuates media stack stop control 56 to directly reposition or unlock and permit repositioning of media stack stop 42. In one embodiment, translation of rotational member 60 directly results in movement of media stack stop 42 to the withdrawn position shown. As a result, the top most sheet driven by pick tire 44 may continue to move along media path 34 past media stack stop 42 into engagement with separation roller 46. In another embodiment, translation of rotational member 60 results in movement of a lock retaining media suck stop 42 in the intercepting position to an unlocked state. As a result, the top most sheet driven by pick tire 44 exerts a sufficient amount of force upon media stack stop 42 to move media stack stop 42 to be withdrawn position. Although media stack stop 42 may return to the intercepting position under the force of gravity, because the lock is in the unlocked state, subsequent sheets of stack 71 driven by pick tire 44 will also move media stack stop 42 from the intercepting position to the withdrawn position so as to permit the driven sheet to move past media stack stop 42 to separation roller 46.

According to one embodiment, downward translation (linear or arcuate) results in media stack stop 42 being lifted or raised to the withdrawn position or results in a lock being lifted or raised to an unlocked state. In other embodiments, power train 54 may alternatively be configured such that upward translation results in media stack stop 42 being lifted or raised or the lock being lifted or raised. In yet other embodiments, translation of rotational member 60 may alternatively result in media stack stop 42 being lowered to be withdrawn position or a lock being lowered to an unlocked state. Although media stack stop 42 is schematically illustrated as linearly moving between the intercepting position and the withdrawn position, in other embodiments, media stack stop 42 may alternatively pivot between the intercepting position and the withdrawn position.

Overall, document feeder 24 automatically controls positioning of media stack stop 42 based upon forces experienced by power train 54 when driving pick tire 44. As noted above, this control is achieved without the use of sensors, without an additional dedicated motor and without the motor having to be reversed. Thus, complexity is reduced.

Although power train 54 is configured such that rotational member 60 translates in response to greater torque being transmitted across power train 54 when pick tire 44 is encountering greater resistance from an engaged sheet as compared to slip surface 52, in other embodiments, this relationship may be reversed. In particular, in other embodiments, the slip surface 52 may be replaced with a surface or member that offers greater resistance to rotation of pick tire 44 as compared to a sheet of media to be picked by pick tire 44. In such an alternative embodiments, rotational member 60 may be configured to translate in response to a greater torque being transmitted across power train 54 when pick tire 44 is in direct contact with the high friction surface (i.e., when a sheet is not present upon tray 40). In such an embodiment, power train 54 may alternatively be configured such that translation of rotational member 60 either moves media stack stop 42 to the intercepting position or moves a lock from an unlocked state to a locked state, retaining media stack stop 42 in the intercepting position.

Figure 3:
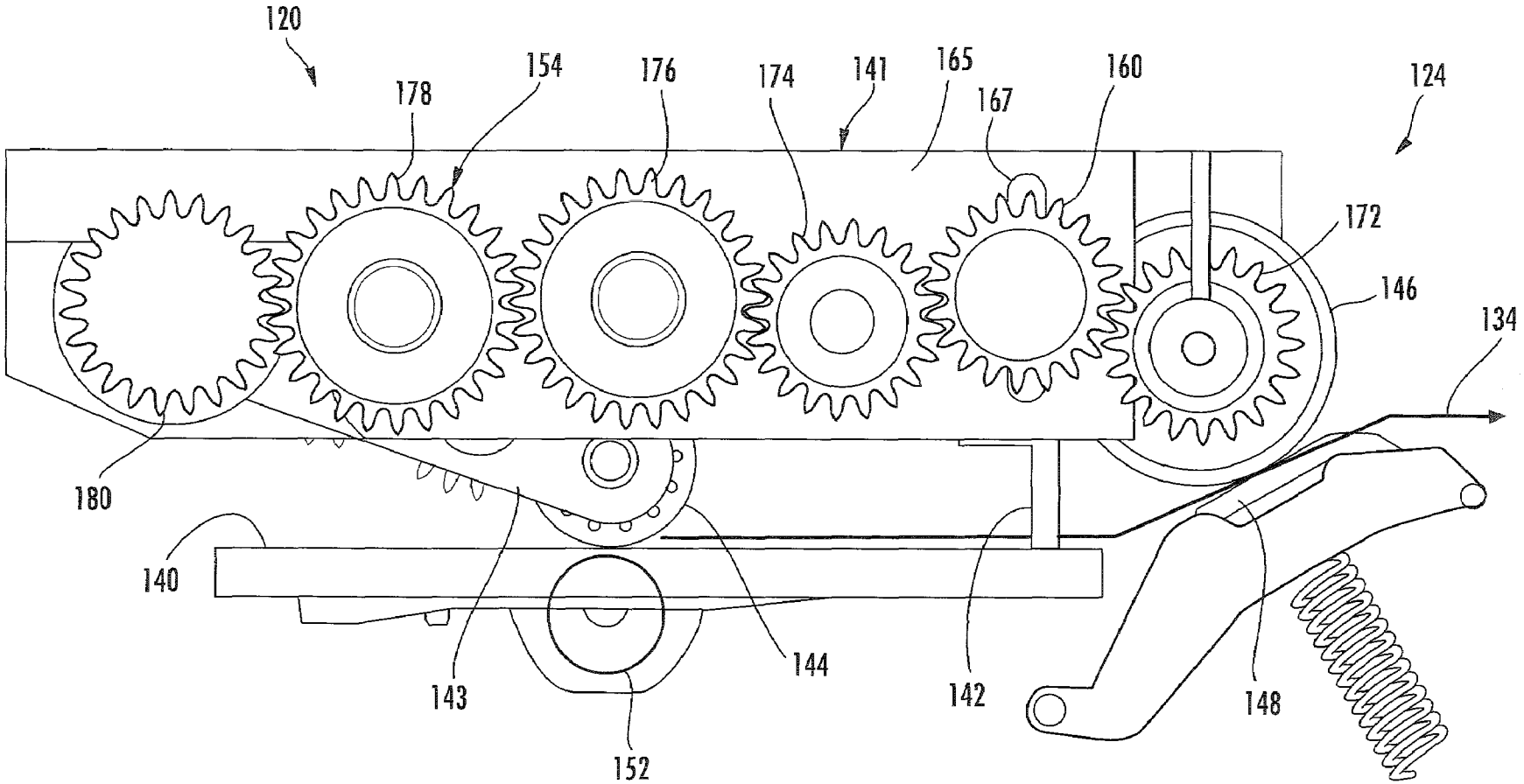
FIG. 3 is a side elevational view of a portion of another embodiment of the apparatus of FIG. 1 illustrating a media stack stop in an intercepting position according to an example embodiment.
Figure 4:
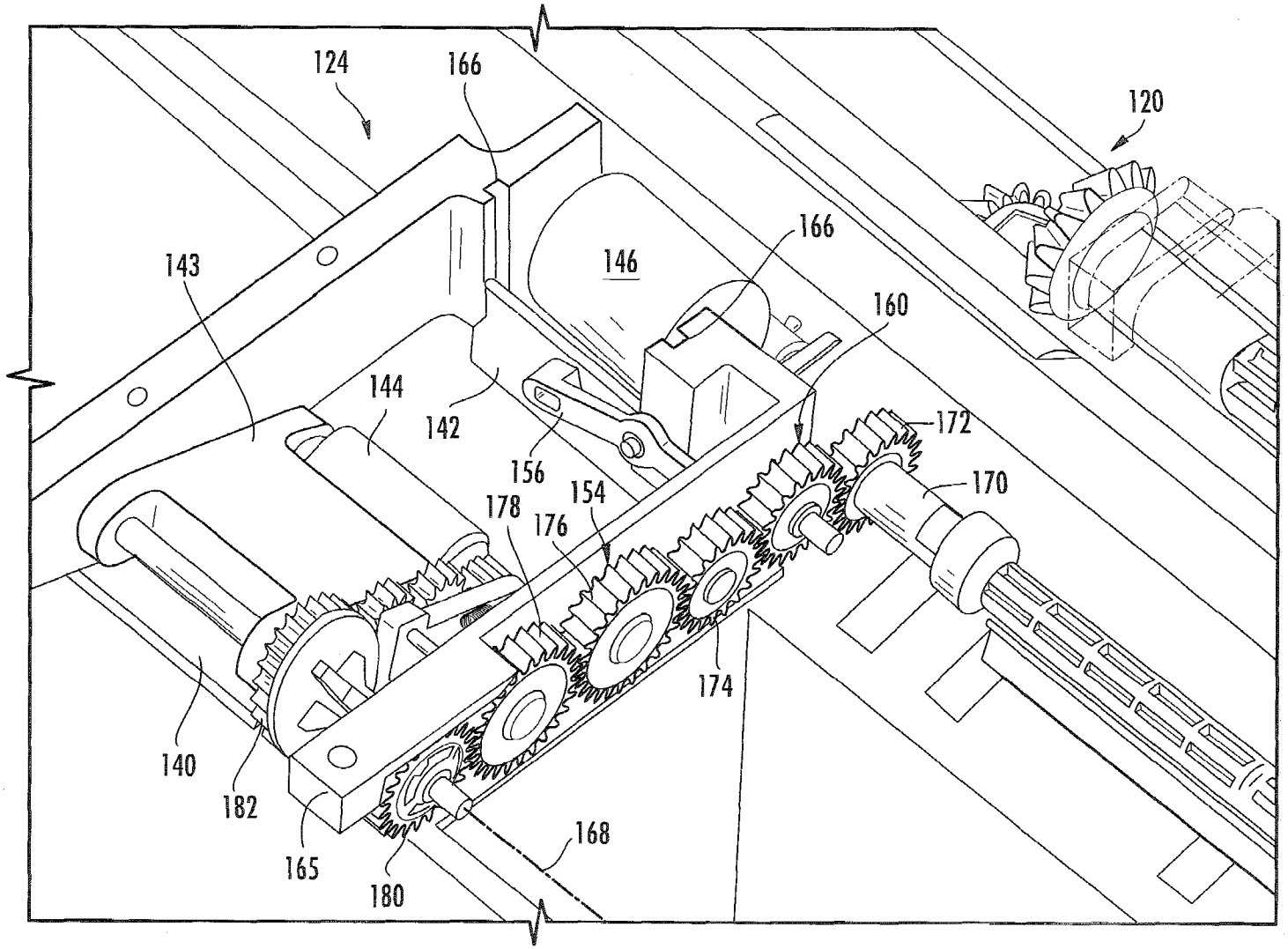
FIG. 4 is a fragmentary top perspective view of the apparatus of FIG. 3 according to an example embodiment.

FIGS. 3-6 illustrate apparatus 120, another embodiment of apparatus 20 shown and described with respect to FIGS. 1 and 2. Apparatus 120 is similar to apparatus 20 in that apparatus 120 includes media direction system 22 shown and described with respect to FIG. 1. Apparatus 120 includes document feeder 124, a particular embodiment of document feeder 24. As shown by FIGS. 3 and 4, document feeder 124 includes media input tray 140, support 141, pick tire 144, arm 143, separation roller 146, separation surface 148, motor 50 (shown in FIG. 1), slip surface 152, power train 154 and media stack stop control 156 (shown in FIGS. 4 and 5). Input tray 140 comprises a platform or surface upon which a stack of sheets may be loaded. Although input tray 40 is illustrated as extending in a generally horizontal plane, in other embodiments, input tray 140 may have other orientations. For example, input tray 140 may alternatively extend in an inclined plane.

Support 141 comprises one or more structures configured to support media stack stop 142, arm 143, pick tire 144, power train 154 and media stack stop control 156 at least partially above tray 140. In the particular example illustrated, support 141 includes a pair of cantilevered bars 164, 165. As shown by FIG. 4, bars 164 and 165 extend on opposite sides of arm 143 and pivotably support arm 143. Bars 164 and 165 each include a pair of opposing channels 166 which movably support and guide media stack stop 142. Bar 165 supports power train 154. As shown by FIG. 3, bar 165 includes a slot 167 configured to permit and guide translation of a rotational member of power train 154. In other embodiments, support 141 may have other configurations for supporting such components of document feeder 124.

Figure 5:
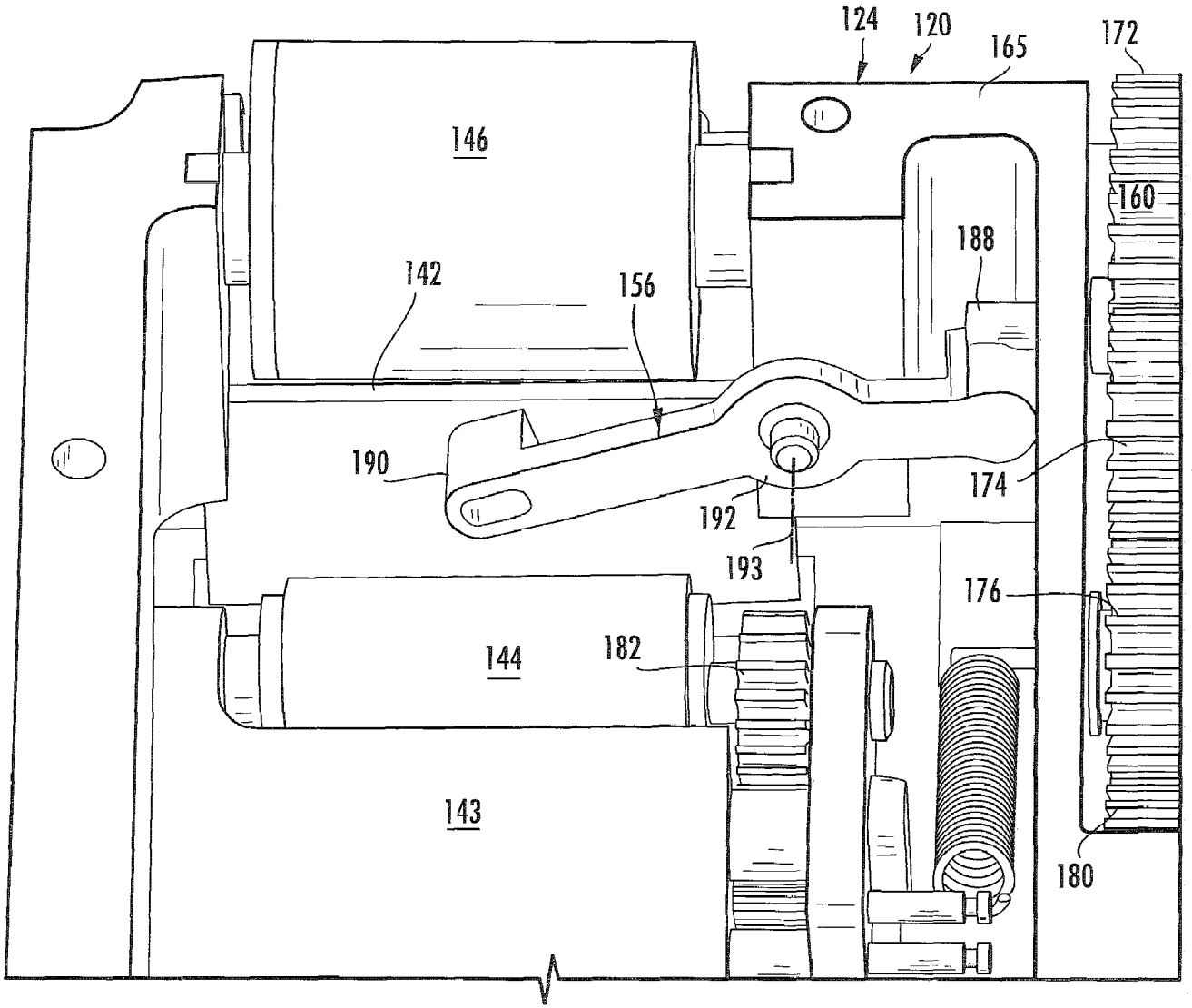
FIG. 5 is an enlarged fragmentary top elevational view of the apparatus of FIG. 4 according to all example embodiment.
Figure 6:
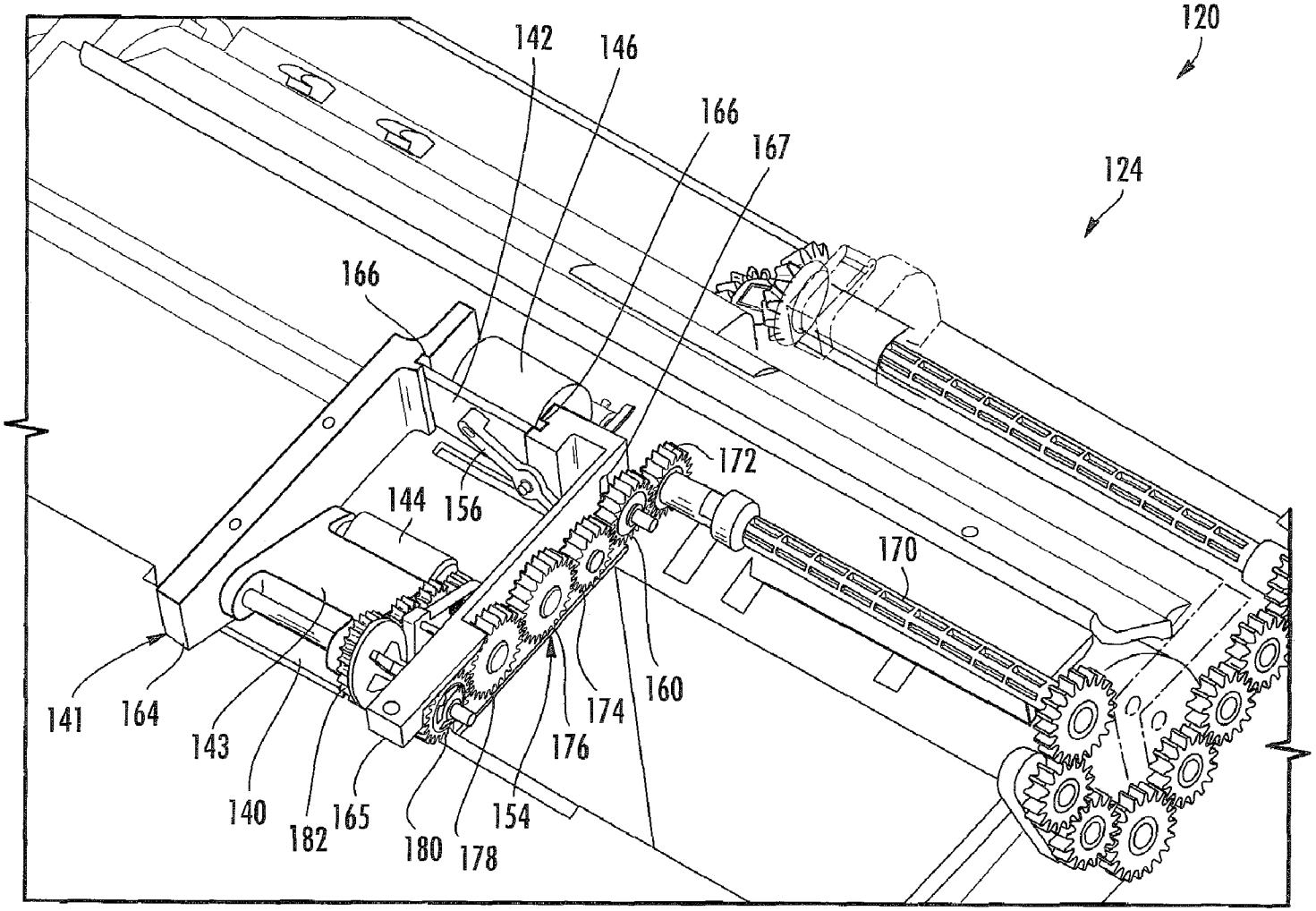
FIG. 6 is a fragmentary top perspective view of the apparatus of FIG. 3 illustrating the media stack stop in a withdrawn position according to an example embodiment.

Media stack stop 142 comprises a gate, wall, fence, tab, blade, prong or other structure configured to move between a blocking or intercepting position (shown in FIGS. 4 and 5) and a withdrawn position (shown in FIG. 6). In the blocking or intercepting position, media stack stop 142 extends across and intercepts media path 134 (shown in FIG. 3). As a result, media stack stop 142 limits an extent to which one or more sheets may be loaded onto tray 140 and moved along media path 134. Media stack stop 142 provides a surface against which leading edges of the sheets of the stack upon tray 140 may abut. Media stack stop 142 assists in controlling positioning of the stack of sheets. Such control over the positioning of sheets loaded onto tray 140 enhances performance of document feeder 124 by reducing the likelihood of mispicks (where a sheet is not separated and fed from the stack) and multipicks (where multiple sheets are concurrently separated and fed from the stack).

In the particular example illustrated, media stack stop 142 provides a surface against which leading edges of the loaded stack abut that is substantially perpendicular to the surface of tray 140. In the example illustrated, media stack stop 142 projects from above and below the upper surface of tray 140 went in the intercepting position shown in FIG. 3. As a result, media stack stop 142 may more reliably engage and intercept the loaded sheets. In other embodiments, however, media stack stop 142 may have other configurations. For example, in other embodiments, media stack stop 142 may provide a surface that abuts leading edges of the stack that is sloped or ramped. In other embodiments, media stack stop 142 may alternatively abut against a top surface of input tray 140. Although media stack stop 142 is illustrated as being spaced above input tray 140 when in the withdrawn position, in other embodiments, a top of media stack stop 142 may alternatively be at or below the surface of media input tray 140 when in the withdrawn position.

Arm 143 comprises one or more structures supporting pick tire 144 opposite to tray 140. In the particular embodiment illustrated, arm 143 pivotally supports arm 143 for pivotal movement about axis 168 towards and away from tray 140. Arm 143 permits pick tire 144 to be pivoted out of engagement with tray 140 and out of engagement with a stack of sheets as a stack of sheets is being loaded. Arm 143 further permits pick tire 144 to be pivoted to accommodate different stack sizes.

Pick tire 144 comprises a member rotationally supported by arm 143 and configured to be rotationally driven while in frictional engagement with a topmost sheet of a stack of sheets loaded upon input tray 40 to drive the topmost sheet further alone media path 134. Although document feeder 124 is illustrated as including a single arm 143 and a single pick tire 144, in other embodiments, document feeder 124 may include multiple arms 143 and multiple pick tires 144.

Separation roller 146 comprises a roller configured to be rotationally driven while in frictional engagement with a topmost sheet that has been driven by pick tire 144 along media path 134. Separation roller 146 continues to drive the sheet along media path 134 to other driven rollers which continue to move the sheet along media path 134.

Separation surface 148 comprises an area generally opposite to separation roller 146 that is configured to inhibit further movement along media path 134 of sheets that may be adhering to a topmost sheet and that are not in contact with separation roller 46. Separation surface 148 assists in reducing the likelihood of multiple sheets being concurrently moved along media path 134. In one embodiment, separation surface 148 comprises a surface having a relatively high coefficient of friction with such sheets. For example, in one embodiment, separation surface 48 may comprise a pad of high friction material such as rubber or cork. Although not illustrated, in other embodiments, additional separation surfaces having teeth or high friction sources may be provided prior to separation roller 46 between pick tire 144 and separation roller 146. In some embodiments, separation surface 148 may be omitted.

Motor 50 (shown in FIG. 1) comprises a source of torque for power train 154 for driving pick tire 144 and separation roller 146. In other embodiments, separate motors may be provided for driving pick tire 144 and separation roller 146. As indicated in broken lines in FIGS. 1 and 2, in another embodiment, motor 50 may be omitted where motor 30 is also operably connected to pick tire 144 and separation roller 146 so as to supply torque to power train 154 for driving pick tire 144 and separation roller 146.

As with slip surface 52, power train 54 and media stack stop control 56 of document feeder 24, slip surface 152, power train 154 and media stack stop control 156 of document feeder 124 cooperate to control the positioning of media stack stop 42, either by physically moving stack stop 142 between the intercepting position or the withdrawn position or by impeding movement of media stack stop 142 from the intercepting position to the withdrawn position or from the withdrawn position to the intercepting position. Slip surface 152, power train 154 and media stack stop control 156 control the positioning of media stack stop 142 based upon whether one or more sheets are loaded onto input tray 140. Slip surface 152, power train 154 and media stack stop control 156 control the positioning of media stack stop 142 based upon the different forces experienced by power train 154 when one or more sheets are loaded onto tray 140 between pick tire 144 and slip surface 152 as compared to when no sheets are loaded onto input tray 140 and pick tire 144 is in direct contact with slip surface 152 or is out of contact with any opposing surface.

According one embodiment, such control by slip surface 152, power train 154 and media stack stop control 156 is achieved without employing sensors for sensing the presence or absence of the sheet upon input tray 140. In the particular example illustrated, such control is achieved without using an additional torque source or motor for moving media stack stop 142. In the particular example illustrated, such control is achieved without motor 50 having to be reversed and with motor 50 being driven in the same direction as used to drive pick tire 144 and separation roller 146. Consequently, document feeder 124 is a less complex.

Slip surface 152 comprises a surface opposite to pick tire 144 that when in contact with pick tire 144 (i.e., in the absence of sheets upon tray 140) that impedes rotation of pick tire 144 to a lesser extent as compared to when sheets are present upon tray 140 and overlie slip surface 152 so as to be in contact with pick tire 144. Slip surface 152 enlarges or exaggerates any differences in the forces experienced by power train 154 when pick tire 144 is a rotationally driven against a sheet as compared to win pick tire 144 is not in contact with a sheet. This enlarged difference between the forces experienced by power train 154 when the sheet is present as compared to when a sheet is not present upon tray 140 is used to automatically control positioning of media stack stop 142.

In the embodiment illustrated, slip surface 152 comprises an idling roller rotationally supported opposite to pick tire 144. In another embodiment, slip surface 152 may comprise a pad of low friction material having a coefficient of friction less than that of sheets to be loaded onto tray 140. For example, slip surface of two may comprise a pad of polytetraflouroethylene (TEFLON). In still other embodiments where the surface of tray 40 opposite to pick tire 44 itself as a coefficient of friction sufficiently different than that of the coefficient of friction with pick tire 144, slip surface 152 may be omitted.

Power train 154 comprises an arrangement of components or members configured to transmit torque from motor 50 (or motor 30) to pick tire 144 and separation roller 146 so as to rotationally drive pick tire 144 and separation roller 146. Power train 154 is further configured such that the forces experienced by power train 154 are used to control positioning of media stack stop 142. As shown by FIG. 4, power train 154 comprises a gear train including rotational member 160 comprising a gear. Power train 154 additionally includes driveshaft 170, gear 172, gear 174, gear 176, gear 178, gear 180 and gear train 182. Driveshaft 170 receives torque from motor 50 (or motor 30) and transmits torque to separation roller 146. Driveshaft 170 further rotationally drives gear 172. Gear 172 transmit torque to rotational member 160 which further transmits torque to pick tire 144 via gears 174, 176, 178, 180 and gear train 182.

As shown by FIG. 5, rotational member 160 is supported by an axle 184 that extends through slot 167 (shown in FIG. 3). Axle 184 is coupled to media stack stop control 156. In one embodiment, axle 184 is fixed to media stack stop control 156. In another embodiment, axle 184 is connected to media stack stop control 156 such that axle 184 may rotate relative to media stack stop control 156 about its rotational axis. In another embodiment, rotational member 160 may rotate with respect to axle 184. When power train 154 transmits additional torque across rotational member 160, such as when pick tire 144 is encountering greater resistance by a sheet of media upon tray 140, rotational member 160 translates in a downward direction along and within slot 167. This translation of rotational member 160 transmits force to media stack stop control 156.

Media stack stop control 156 comprises an arrangement of one or more components physically connecting rotational member 160 to media stack stop 142. In the particular embodiment shown, media stack stop control 156 comprises a lever having a first end 188 coupled rotational member 160, a second end 190 coupled to media stack stop 142 and an intermediate portion 192 rotationally supported by bar 165 for pivotal movement about axis 193. As a result, translation of member 160 moves media stack stop 142 between the intercepting position and the withdrawn position. Such movement of media stack stop 142 may be proportional to the movement of rotational member 160 or may be larger or smaller using appropriately configured intermediate structures. In the embodiment illustrated, downward movement or translation of rotational member 160 results in media stack stop 142 being lifted and upward translation of rotational member 160 results in media stack stop 142 being lowered.

FIGS. 3-5 illustrate apparatus 120 prior to loading of a sheet or stack of sheets onto input tray 140. In the absence of any sheets having been loaded onto input tray 140, pick tire 144 directly contacts slip surface 152. As a result, pick tire 144 and power train 154 experience less resistance as compared to when pick tire 144 is in engagement with a sheet upon input tray 140. As a result, rotational member 160 is in an at-rest position and media stack stop 142 is in the intercepting position. In one embodiment, media stack stop 142 is biased towards the intercepting position by gravity and is cannot be moved from the intercepting position when rotational member 160 is in the at-rest position. Upon completion of a job, after the last sheet of a stack has been picked from tray 140, rotational member 160 will automatically return to its at-rest position, automatically returning media stack stop 142 to the intercepting position.

FIG. 6 illustrates apparatus 120 after a stack of sheets has been loaded onto tray 140. Such loading occurs when pick tire 144 is not being driven or when pick tire 144 has been moved to a position spaced from tray 140 to permit the stack to be loaded without pick tire 144 contacting the loaded stack. During such loading, as described above with respect to FIGS. 3-5, media stack stop 142 is in the intercepting position. As a result, the stack of sheets may be loaded and inserted by a person until the leading edge of the stack abuts or contact media stack stop 142. Media stack stop 142 provides a person loading the stack of sheets with a positive indication that the stack has been loaded and sufficiently inserted into document feeder 124. Media stack stop 42 further prevents insertion of the stack too far into document feeder 124 which could potentially resulted subsequent misfeeding by document feeder 124. After loading of the stack, pick tire 144 is lowered or otherwise moved into engagement with a topmost sheet of the stack.

FIG. 6 illustrates the initiation of torque being supplied to power train 154 and pick tire 144 after the stack has been loaded. Because the stack has been loaded, pick tire 144 engages a top most sheet of the stack which offers a greater resistance to rotation of pick tire 144 as compared to slip surface 152. This greater resistance causes greater torque to be transmitted across power train 54. The additional torque transmitted across power train 154 is sufficient to translate rotational member 160. Such translation pivots the lever of media stack stop control 156 to lift media stack stop 42 to the withdrawn position shown. As a result, the top most sheet driven by pick tire 144 may continue to move along media path 134 past media stack stop 142 into engagement with separation roller 146.

Figure 7:
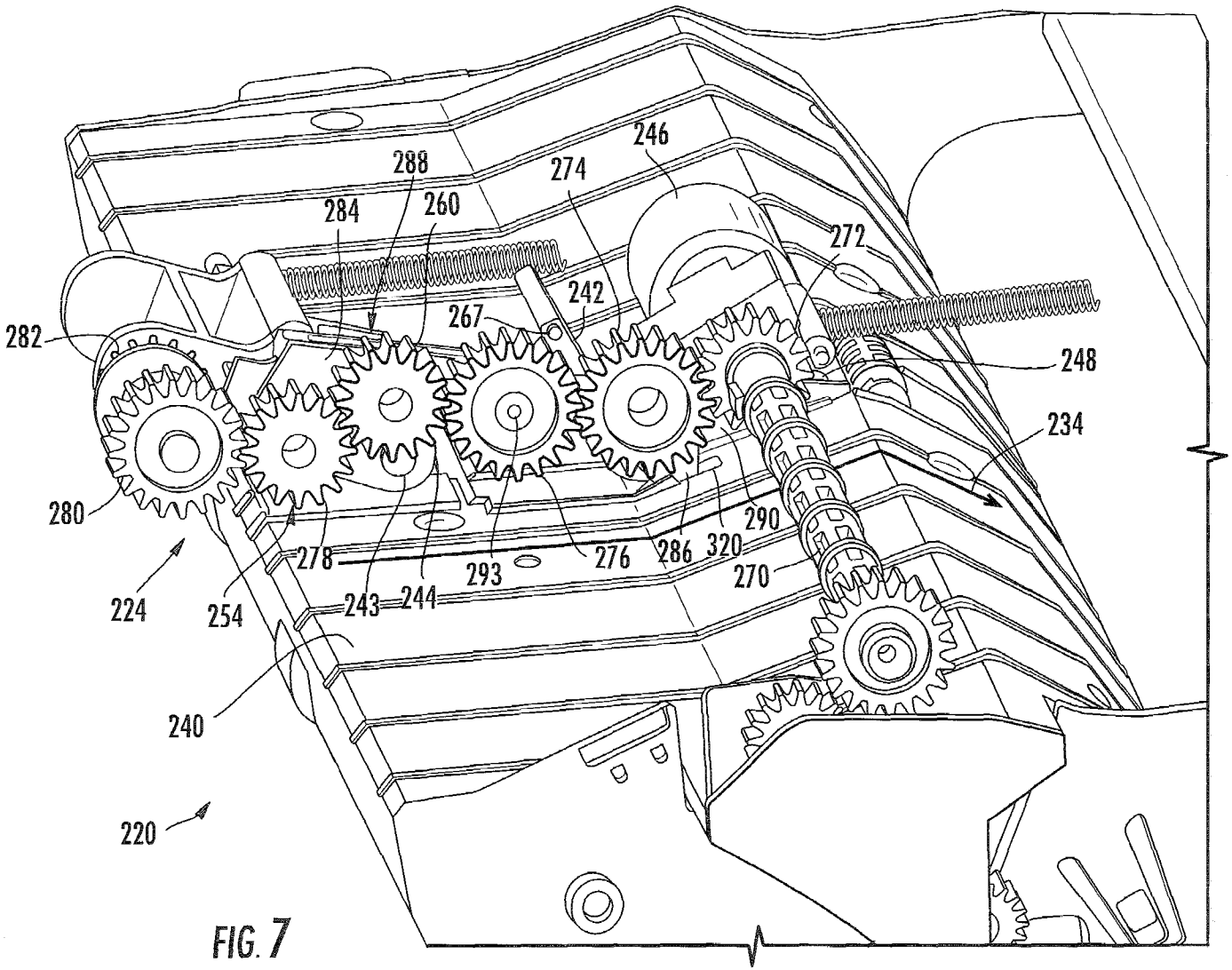
FIG. 7 is a fragmentary top perspective view of another embodiment of the apparatus of FIG. 1 illustrating a media stack stop in an intercepting position according to an example embodiment.
Figure 8:
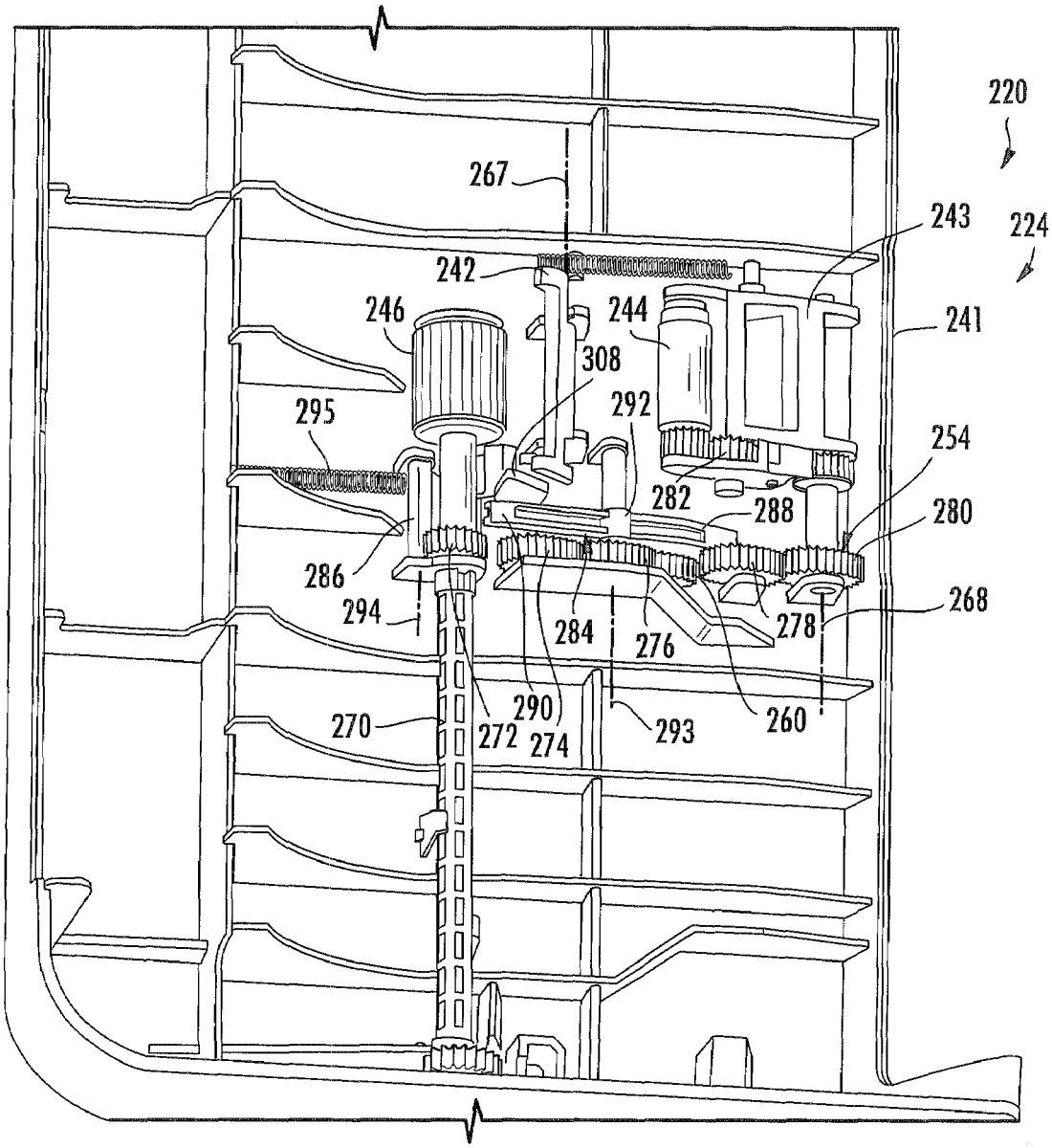
FIG. 8 is a bottom plan view of a portion of the apparatus of FIG. 7 according to an example embodiment.

FIGS. 7-11 illustrate apparatus 220, another embodiment of apparatus 20. Apparatus 220 is similar to apparatus 20 in that apparatus 220 includes media interaction system 22 shown and described with respect to FIG. 1. Apparatus 220 includes document feeder 224, a particular embodiment of document feeder 24. As shown by FIGS. 7 and 8, document feeder 224 includes media input tray 240, support 241, pick tire 242, arm 243, separation roller 246, separation surface 248, motor 50 (shown in FIG. 1), slip surface 252, power train 954 and media stack stop control 256. Input tray 240 comprises a platform or surface upon which a stack of sheets may be loaded. Although input tray 240 is illustrated as extending in a generally horizontal plane, in other embodiments, input tray 240 may have other orientations. For example, input tray 240 may alternatively extend in an inclined plane.

Support 241 comprises one or more structures configured to support media stack stop 242, arm 243, pick tire 244, power train 254 and media stack stop control 256 at least partially above tray 140. In the particular embodiment illustrated, support 241 comprises a single structure serving as a lid or cover that extends over tray 240 while suspending such components above tray 140. In other embodiments, support 241 may have other configurations.

Figure 10:
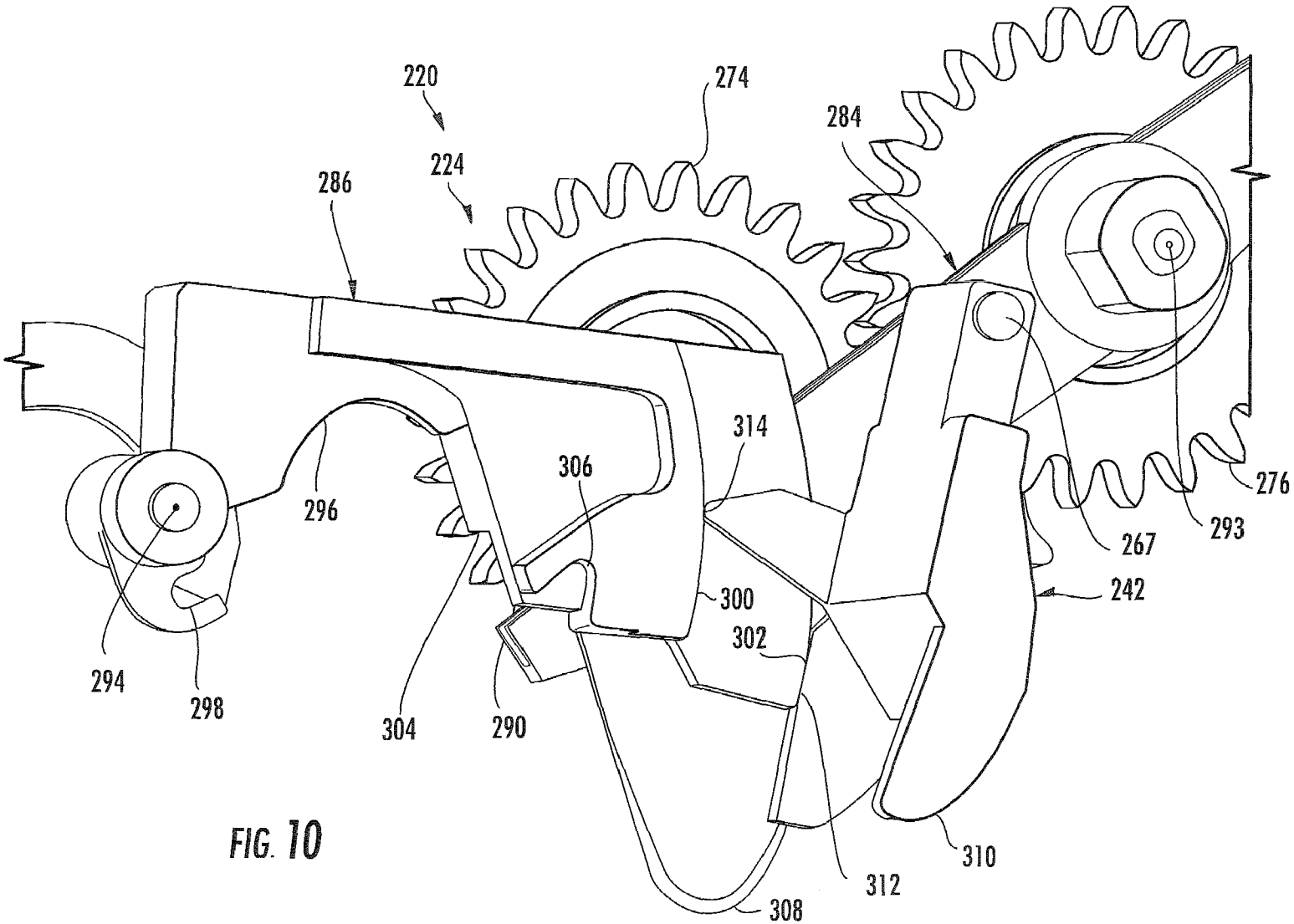
FIG. 10 is a greatly enlarged perspective view of portions of the apparatus of FIG. 9 according to an example embodiment.
Figure 11:
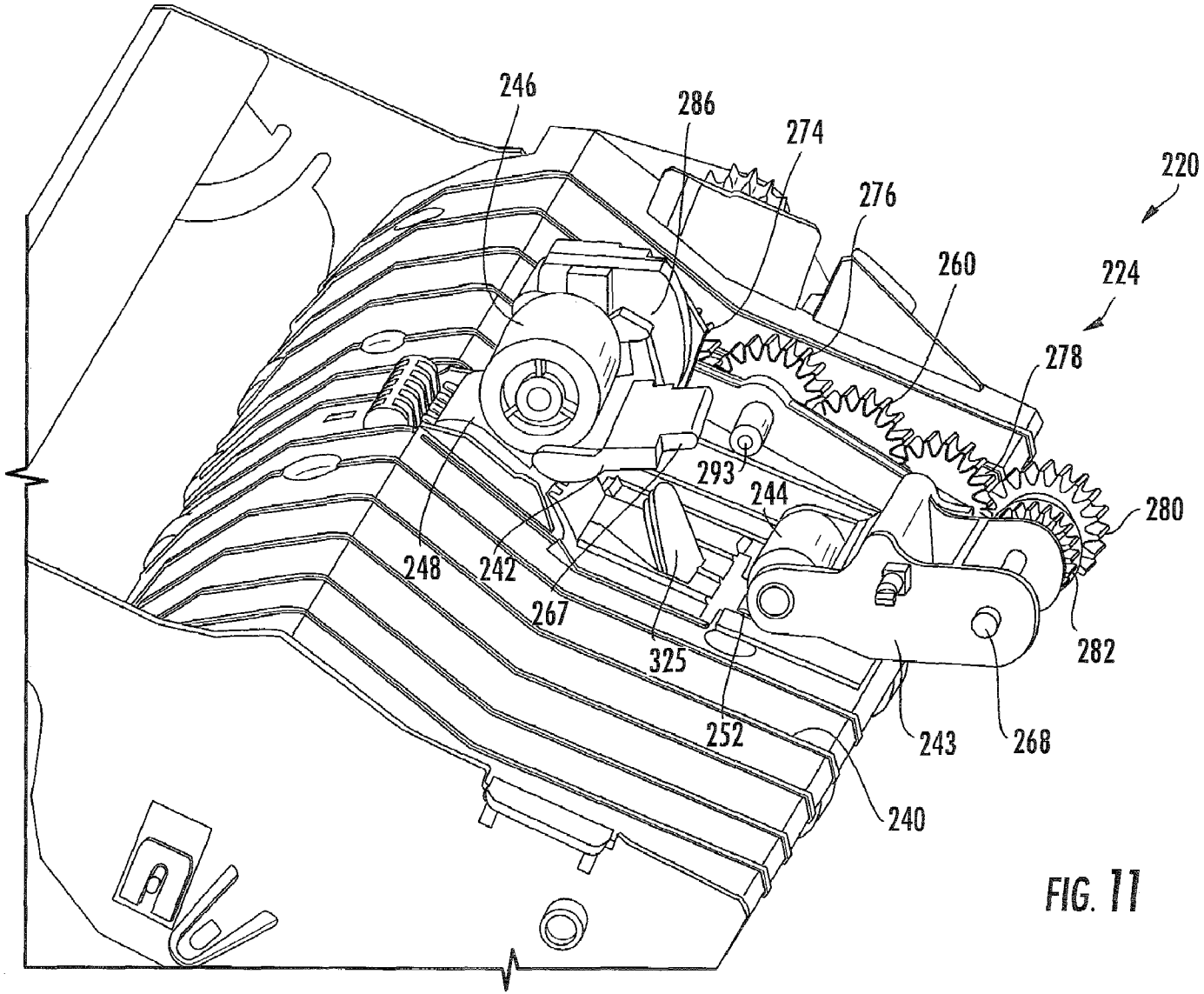
FIG. 11 is an enlarged fragmentary top perspective view of the apparatus of FIG. 9 illustrating a media stack stop and a withdrawn position according to an example embodiment.

Media stack stop 242 comprises a gate, wall, fence, tab, blade, prong or other structure configured to move between a blocking or intercepting position (shown in FIGS. 7-10) and a withdrawn position (shown in FIG. 11). In the blocking or intercepting position, media stack stop 242 extends across and intercepts media path 234. As a result, media stack stop 242 limits an extent to which one or more sheets may be loaded onto tray 240 and moved along media path 234. Media stack stop 242 provides a surface against which leading edges of the sheets of the stack upon tray 240 may abut. Media stack stop 242 assists in controlling positioning of the stack of sheets. Such control over the positioning of sheets loaded onto tray 240 enhances performance up document feeder 224 by reducing the likelihood of mispicks (where a sheet is not separated and fed from the stack) and multipicks (where multiple sheets are concurrently separated and fed from the stack).

FIG. 8 illustrates those portions of document feeder 224 suspended by support 241 above tray 240 (which is not shown in FIG. 8). In the remaining figures of document feeder 224, support 241 is omitted for purposes of illustration. As shown by FIG. 8, media stack stop 242 is pivotably supported by support 241 so as to hang from support 241 to tray 240 and so as to pivot about an axis 267. Media stack stop 242 is pivotably supported such that a sheet being driven by pick tire 244 has sufficient force to pivot media stack stop 242 when media stack stop 242 is not being retained in place by media stack stop control 256 as will be described hereafter. In other embodiments, media stack stop 242 may have other configurations.

Arm 243 comprises one or more structures supporting pick tire 244 opposite to tray 240. In the particular embodiment illustrated, arm 243 pivotally supports pick tire 244 for pivotal movement about axis 268 (shown in FIG. 8) towards and away from tray 240. Arm 243 permits pick tire 244 to be pivoted out of engagement with tray 240 and out of engagement with a stack of sheets as a stack of sheets is being loaded. Arm 243 further permits pick tire 244 to be pivoted to accommodate different stack sizes.

Pick tire 244 comprises a member rotationally supported by arm 243 and configured to be rotationally driven while in frictional engagement with a topmost sheet of a stack of sheets loaded upon input tray 240 to drive the topmost sheet further alone media path 234. Although document feeder 224 is illustrated as including a single arm 243 and a single pick tire 244, in other embodiments, document feeder 224 may include multiple arms 243 and multiple pick tires 244.

Separation roller 246 comprises a roller configured to be rotationally driven while in frictional engagement with a topmost sheet that has been driven by pick tire 244 along media path 234. Separation roller 246 continues to drive the sheet along media path 234 to other driven rollers which continue to move the sheet along media path 234.

Separation surface 248 (shown in the FIG. 9) comprises an area generally opposite to separation roller 246 that is configured to inhibit further movement along media path 234 of sheets that may be adhering to a topmost sheet and that are not in contact with separation roller 246. Separation surface 248 assists in reducing the likelihood of multiple sheets being concurrently moved along media path 234. In one embodiment, separation surface 248 comprises a surface having a relatively high coefficient of friction with such sheets. For example, in one embodiment separation surface 248 may comprise a pad of high friction material such as rubber or cork. Although not illustrated, in other embodiments, additional separation surfaces having teeth or high friction sources may be provided prior to separation roller 246 between pick tire 244 and separation roller 246. In some embodiments, separation surface 248 may be omitted.

Motor 50 comprises a source of torque for power train 254 for driving pick tire 244 and separation roller 246. In other embodiments, separate motors may be provided for diving pick tire 244 and separation roller 246. As indicated in broken lines in FIG. 1, in another embodiment, motor 50 may be omitted where motor 30 of media interaction system 22 is also operably connected to pick tire 244 and separation roller 246 so as to supply torque to power train 254 for driving pick tire 244 and separation roller 246.

As with slip surface 52, power train 54 and media stack stop control 56 of document feeder 24, slip surface 252, power train 254 and media stack stop control 256 of the document feeder 224 cooperate to control the positioning of media stack stop 242 by impeding movement of media stack stop 42 from the intercepting position to the withdrawn position. Slip surface 252, power train 254 and media stack stop control 256 control the positioning of media stack stop 242 based upon whether one or more sheets are loaded onto input tray 240. Slip surface 252, power train 254 and media stack stop control 256 control the positioning of media stack stop 242 based upon the different forces experience by power train 254 when one or more sheets are loaded onto tray 240 between pick tire 244 and slip surface 252 as compared to when no sheets are loaded onto input tray 240 and pick tire 244 is in direct contact with slip surface 252 or is out of contact with any opposing surface.

According one embodiment, such control by slip surface 252, power train 254 and media stack stop control 256 is achieved without employing sensors for sensing the presence or absence of the sheet upon input tray 240. In the particular example illustrated, such control is achieved without using an additional torque source or motor for moving media stack stop 242. In the particular example illustrated, such control is achieved without motor 50 having to be reversed and with motor 50 being driven in the same direction as used to drive pick tire 244 and separation roller 246. Consequently, document feeder 224 is a less complex.

Slip surface 252 comprises a surface opposite to pick tire 244 that when in contact with pick tire 244 (i.e., in the absence of sheets upon tray 40) that impedes rotation of pick tire 244 to a lesser extent as compared to when sheets are present upon tray 240 and overlie slip surface 252 so as to be in contact with pick tire 244. Slip surface 252 enlarges or exaggerates any differences in the forces experienced by power train 254 when pick tire 244 is a rotationally driven against a sheet as compared to when pick tire 244 is not in contact with a sheet. This enlarged difference between the forces experienced by power train 254 when the sheet is present as compared to when the sheet is not present upon tray 40 is used to automatically control positioning of media stack stop 242.

In the embodiment illustrated, slip surface 252 comprises an idling roller rotationally supported opposite to pick tire 244. In another embodiment, slip surface 252 may comprise a pad of low friction material having a coefficient of friction less than that of sheets to be loaded onto tray 240. For example, slip surface 252 may comprise a pad of polytetrafluoroethylene (TEFLON). In still other embodiments where the surface of tray 240 opposite to pick tire 244 itself as a coefficient of friction sufficiently different than that of the coefficient of friction with pick tire 244, slip surface 252 may be omitted.

Power train 254 comprises an arrangement of components or members configured to transmit torque from motor 50 (or motor 30) to pick tire 244 and separation roller 246 so as to rotationally drive pick tire 244 and separation roller 246. Power train 254 is further configured such that the forces experienced by power train 254 are used to control positioning of media stack stop 242. As shown by FIG. 7, power train 254 comprises a gear train including rotational member 260 comprising a gear. Power train 254 additionally includes driveshaft 270, gear 272, gear 274, gear 276, gear 278, gear 280 and gear train 282. Driveshaft 270 receives torque from motor 50 (or motor 30) and transmits torque to separation roller 246. Driveshaft 270 further rotationally drives gear 272 mounted on driveshaft 270. Gear 272 transmits torque to gear 274 rotationally supported by support 241. Gear 274 transmits torque to gear 276 which transmits torque to rotational member 260. Rotational member 260 further transmits torque to pick tire 244 via gear 278, gear 280 and gear train 282.

Media stack stop control 256 composes an arrangement of one or more components is physically connecting rotational member 260 to media stack stop 242. In the particular embodiment shown, media stack stop control 256 operably couples rotational member 260 to media stack stop 242 such that translation of rotational member 260 moves another intermediate member into or out of engagement with media stack stop 242 so as to retain media stack stop 242 in a selected position or permit movement of media stack stop 242 to a selected position. In the particular example illustrated, media stack stop control 256 includes swing arm 284 and lock 286. As shown by FIG. 8, swing arm 284 comprises a lever having a first end portion 288 rotationally supporting rotational member 260, a second end portion 290 configured to abut and engage lock 286 on an underside of lock 286 (note that FIG. 8 is an inverted view of support 241 and supported components), and an intermediate portion 292 pivotably connected to and supported by support 241 for pivotal movement about axis 293.

As shown by FIG. 8, lock 286 comprises a structure pivotably supported support 241 pivotal movement about axis 294. In the example illustrated, lock 286 is resiliently biased towards tray 240 by a spring 293. In other embodiments, spring 295 may be omitted.

Lock 286 is configured to interact with media stack stop 242 so as to retain media slack stop 242 in the intercepting position until lock 286 is pivoted and lifted by swing arm 284. FIG. 10 is an enlarged view illustrating interaction between lock 286, media stack stop 242 and swing arm 284. As shown by FIG. 10, lock 286 includes collar 296, hook 298, engagement surfaces 300, 302, shoulder 304, stop registration surface 306 and nose 308. Collar 296 comprises an arcuate surface configured to register on top of a portion of driveshaft 270. Collar 296 engages driveshaft 270, which serves as a datum, for controlling the position of lock 286 when lock 286 is not being lifted by swing arm 284 and is in the lowered and locked state as shown. In other embodiments, other structures may be used to control positioning of lock 286 when lock 286 is in the locked state.

Hook 298 comprises structure configured to be secured to an end of spring 295 on a same side of axis 294 as that of nose 308. As a result, spring 295 (shown in FIG. 8) biases nose 308 towards tray 240. In embodiments where spring 295 is omitted and where lock 286 relies upon gravity and its mass to inhibit movement of media stack stop 242, hook 298 may be omitted.

Engagement surfaces 300 and 302 comprise shoulders configured to abut portions of media stack stop 242 when media stack stop 242 is in the intercepting position and when lock 286 is in the lowered locked state. In the particular example illustrated, media stack stop 242 includes blades 310, 312 configured to abut leading edges of a stack of sheets upon tray 240 (shown in FIG. 7). Media stack stop 242 additionally includes a rearwardly projecting prong 314. Surfaces 300 and 302 abut and engage blade 312 and prong 314 when lock 286 is in the lowered locked state to inhibit pivotal movement of media stack stop 242 about axis 267. As a result, media stack stop 242 is retained in the intercepted position when lock 286 is in the locked state shown. Engagement surfaces 300 and 302 are further configured such that lock 286 may be lifted and pivoted upwardly out of engagement with media stack stop 242 to an unlocked state.

Shoulder 304 facilitates lifting and pivoting of lock 286 from the locked state shown in FIG. 10 to an unlocked state shown in FIG. 11. Shoulder 304 is configured to extend generally opposite to end portion 290 at swing arm 284. Shoulder 304 is configured such that pivotal movement of swing arm 284 in a clockwise direction as seen in FIG. 10 results in end portion 290 contacting an engaging shoulder 304 to lift lock 286 and to pivot lock 286 about axis 294. Shoulder 304 is also configured such that pivotal movement of swing arm 284 in a counterclockwise direction as seen in FIG. 10 results in end portion 290 being lowered out of engagement with shoulder 304, permitting lock 286 to either fall under the force of gravity or with the assistance of spring 295 to the locked state.

Recess 306 comprises a notch configured to receive prong 314 when lock 286 has been pivoted to the unlocked state and when media stack stop 242 has been pivoted to be withdrawn position. Recess 306 provides clearance for prong 314 when lock 286 is in the unlocked state. FIG. 11 illustrates lock 286 in the unlocked state and media stack stop 242 pivoted to the withdrawn position. In other embodiments, recess 306 may be omitted.

Nose 308 comprises a lower portion of lock 286 extending towards tray 240. Nose 308 is configured to project below and beyond media stack stop 242. In circumstances where support 241 is lifted away from tray 240 for clearing a media jam and where a person loads a stack of sheets upon tray 240 when support 241 is raised, nose 308 engages a stack prior to media stack stop 242 when support 241 is once again lowered. As a result, nose 308 engages the media and unlocks lock 286 before media stack stop 242 engages the media. Unlocking lock 286 with nose 308, permits media stack stop 242 to pivot or move to the withdrawn position upon engaging the media to lessen potential damage to the media as compared to alternatively engaging the media with a locked media stack stop. Because nose 308 has a smooth, rounded and wide lower tip nose 308 is less likely to mark or damage the media. In those circumstances where a person, correctly, does not load a stack of sheets upon tray 240 when support 241 is raised, lowering of support 241 lowers nose 308 of lock 286 through opening 320. In other embodiments, nose 308 may be omitted.

Figure 9:
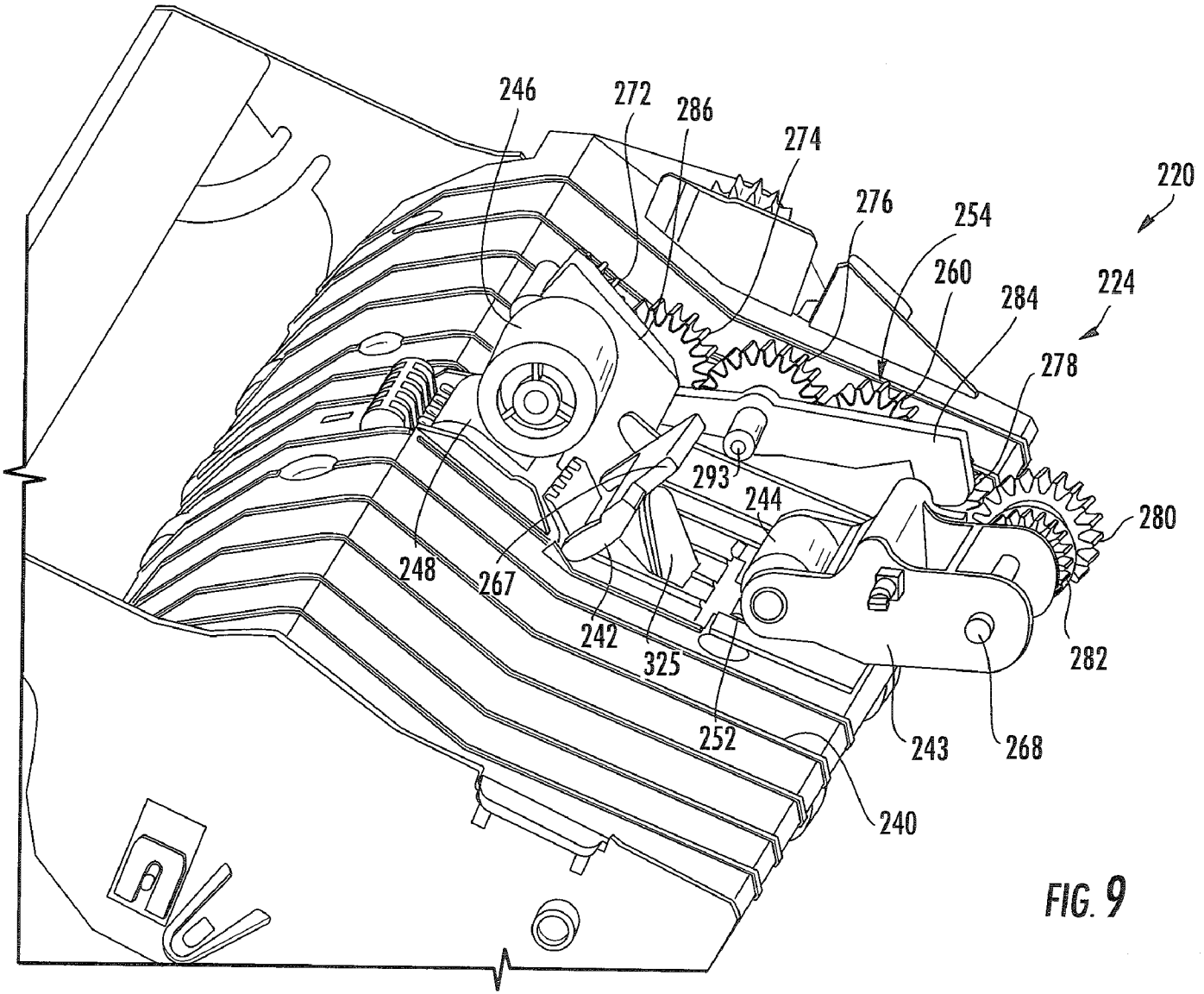
FIG. 9 is a top fragmentary perspective view of the apparatus of FIG. 7 according to an example embodiment.

FIGS. 9 and 10 illustrate operation of document feeder 224 and apparatus 220. FIG. 9 illustrates apparatus 220 prior to loading of a sheet or stack of sheets onto input tray 240. In the absence of any sheets having been loading onto input tray 240, pick tire 244 directly contacts slip surface 252. As a result, pick tire 244 and power train 254 experience less resistance as compared to when pick tire 244 is in engagement with a sheet upon input tray 240. As a result, rotational member 260 is in an at-rest position and media stack stop 242 is in the intercepting position. Media stack stop 242 is biased toward the intercepting position by gravity and is retained in the intercepting position by lock 286 when rotational member 260 is in the at-rest position. The positioning of media stack stop 242 in the intercepting position does not change even when motor 50 is supplying torque so as to drive pick tire 44.

FIG. 11 illustrates apparatus 220 after a stack of sheets has been loaded onto tray 240. Such loading occurs when pick tire 244 is not being driven or when pick tire 244 has been moved to a position spaced from tray 240 to permit the stack to be loaded without pick tire 244 contacting the loaded stack. During such loading, as described above with respect to FIGS. 9 and 10, media stack stop 242 is in the intercepting position. As a result, the stack may be loaded and inserted by a person until the leading edges of the stack abut or contact media stack stop 242. Media stack stop 242 provides a person loading the stack with a positive indication that the stack has been loaded and sufficiently inserted into document feeder 224. Media stack stop 242 further prevents insertion of the stack too far into document feeder 224 which could potentially resulted subsequent misfeeding by document feeder 224. After loading of the stack, pick tire 244 is lowered or otherwise moved into engagement with a topmost sheet of the stack.

As shown by FIG. 11, in the example illustrated, document feeder 224 includes a flag 325 which is depressed upon insertion of a stack of sheets. Movement of the flag is sensed by a sensor. However, actuation of media stack stop 242 is independent of flag 325 or the sensed positioning of flag 325. In some embodiments, flag 325 may be omitted.

FIG. 11 illustrates the initiation of torque being supplied to power train 254 and pick tire 244 after the stack has been loaded. Because the stack has been loaded, pick tire 244 engages a top most sheet of the stack which offers a greater resistance to rotation of pick tire 244 as compared to slip surface 252. This greater resistance causes greater torque to be transmitted across power train 254. The additional torque transmitted across power train 254 is sufficient to translate rotational member 260. In particular, rotational member 260 rolls in a downward direction against gear 276. Such translation results in swing arm 284 pivoting about axis 293. This further results in end portion 290 engaging shoulder 304 of lock 286 to lift lock 286 to an unlocked state, freeing media stack stop 242 for pivotal movement. The sheet picked by pick tire 244 and driven by pick tire 244 against media stack stop 242 pivots media stack stop 242 from the intercepting position to the withdrawn position. Although media stack stop 242 may return to the intercepting position under the force of gravity, because the lock 286 is in the unlocked state, subsequent sheets of the stack driven by pick tire 244 will also move media stack stop 242 from the intercepting position to the withdrawn position so as to permit the driven sheet to move past media stack stop 242 to separation roller 246.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a pick tire configured to pick a sheet from a stack;

a power train operably coupled to the pick tire to drive the pick tire, the power train including a gear that translates based upon a presence or absence of a sheet in engagement with the pick tire and based on a transmission of force to the pick tire; and a media stack stop movable between a media path intercepting position and a withdrawn position, wherein movement of the stack stop between the intercepting position and the withdrawn position is dependent upon positioning of the gear, wherein the media stack stop is configured to be in the media path intercepting position during rotation of the pick tire and wherein the gear translates during driving of the power train while the media stack stop is in the media path intercepting position and while a rotational axis of the pick tire is not translating.

2. The apparatus of claim 1 further comprising a lock movable between a locked state in which the lock retains the stack stop in the intercepting position and an unlocked state, wherein movement of the lock between the locked state and the unlocked state is dependent upon positioning of the gear.

3. The apparatus of claim 2, wherein the lock pivots about an axis between the locked state and the unlocked state.

4. The apparatus of claim 2, wherein the lock is biased towards the locked state by gravity.

5. The apparatus of claim 2 further comprising a floor opposite to the lock, wherein the lock has a nose projecting beyond the media stack stop when the media stack stop is in the intercepting position and wherein the nose extends through the floor in the locked state in the absence of a sheet upon the floor.

6. The apparatus of claim 1, wherein the stack stop pivots between the intercepting position and the withdrawn position.

7. The apparatus of claim 1, wherein the gear slides along a slot and wherein the stack stop is coupled to the gear such that translation of the gear along the slot creates motion which is transmitted to the stack stop to move the stack stop.

8. The apparatus of claim 1, wherein the gear slides along a slot.

9. The apparatus of claim 1, wherein the gear rotates about a first axis and pivots about a second axis.

10. The apparatus of claim 1, wherein the pick tire is on a first side of the stack stop, wherein the apparatus further comprises a roller on a second side of the stack stop with the stack stop in the intercepting position and wherein the power train is operably coupled to the roller to drive the roller.

11. The apparatus of claim 1 further comprising:

a media tray opposite the pick tire; and a low resistance member adjacent to the media tray opposite the pick tire, the member being configure to contact the pick tire in the absence a sheet on the tray and to offer less resistance to rotation of the pick tire than when a sheet is engaged by to pick tire.

12. The apparatus of claim 11, wherein the low resistance member comprises an idling roller.

13. The apparatus of claim 1 further comprising:

a lock pivotable about a first axis between a locked state in which the lock retains the stack stop in the intercepting position and an unlocked state;

a swing arm pivotable about a second axis and carrying the gear, wherein translation of the gear pivots the swing arm against the lock so as to lift the lock and pivot the lock from the locked state to the unlocked state, wherein the media stack stop is configured to move from the intercepting position to the withdrawn position upon being contacted by a sheet of media with a force when the lock is in the unlocked state and wherein the lock, in the locked state, inhibits movement of the media stack stop from the intercepting position to the withdrawn position upon being contacted by the sheet with the same force, wherein the gear slides along a slot and wherein the swing arm is coupled to the gear such that translation of the gear along the slot creates motion which is transmitted to the swing arm to pivot the swing arm.

14. The apparatus of claim 1 further comprising:

a scanner bed including an image sensor; and a lid above the scanner bed, the lid supporting the pick tire.

15. A method comprising:

driving a pick tire with a power train having a gear;

translating the gear in response to presence of a sheet opposite to the pick tire during driving of the pick tire without translating a rotational axis of the pick tire;

interrupting movement of media past a stack stop in an interrupting position depending upon positioning of the gear; and driving the pick tire with the stack stop in the interrupting position.

16. The method of claim 15 further comprising pivoting a swing arm against a lock to pivot the lock from a locked state in which the lock retains the stack stop in the intercepting position to an unlocked state permitting movement of the stack stop to a withdrawn position, wherein the stack stop is configured to move from the interrupting position to the withdrawn position upon being contacted by a sheet of media with a force when the lock is in the unlocked state and wherein the lock, in the locked state, inhibits movement of the media stack stop from the interrupting position to the withdrawn position upon being contacted by the sheet with the same force, wherein the gear slides along a slot and wherein the swing arm is coupled to the gear such that translation of the gear along the slot creates motion which is transmitted to the swing arm to pivot the swing arm.

17. The method of claim 16 further comprising lowering the lock so as to extend from above a tray surface configured to support a sheet to below the surface in the absence of a sheet upon the tray and so as to move the lock against a top of any sheet present on the tray to move the lock to the unlocked state.

18. The method of claim 15 further comprising pivoting the stack stop from the media interrupting position to a withdrawn position, in which the stack stop is positioned so permit media to pass by the stack stop, as the gear translates.

19. The method of claim 15 further comprising rolling the pick tire against an idling roller in absence of a sheet opposite the pick tire.

20. An apparatus comprising:

a pick tire;

a media interaction device;

a media path extending from the pick tire to the media interaction device;

a power train operably connected to the pick tire;

a motor coupled to the power train;

a media stack stop; and means for moving the media stack stop from a media path intercepting position in which movement of media past the stack stop is inhibited to a withdrawn position in which movement of media past the stack stop is permitted without reversing the motor, the means including a gear of the power train, wherein the gear translates during driving of the power train while the media stack stop is in the media path intercepting position and while a rotational axis of the pick tire is not translating.

21. An apparatus comprising:

a pick tire configured to pick a sheet from a stack;

a power train operably coupled to the pick tire to drive the pick tire, the power train including a gear that translates based upon a presence or absence of a sheet in engagement with the pick tire and based on a transmission of force to the pick tire; and a media stack stop movable between a media pass intercepting position and a withdrawn position, wherein movement of the stack stop between the intercepting position and the withdrawn position is dependent upon positioning of the gear, wherein the media stack stop is configured to be in the media pass intercepting position during rotation of the pick tire, wherein the gear slides along a slot and wherein the stack stop is coupled to the gear such that translation of the gear along the slot creates motion which is transmitted to the stack stop to move the stack stop.

* * * * *

UNITED STATES PATENT AND TRADEMARK OFFICE

CERTIFICATE OF CORRECTION

PATENT NO. : 7,651,082 B2
APPLICATION NO. : 11/740146
DATED : January 26, 2010
INVENTOR(S) : Steven W. Hendrix et al.

It is certified that error appears in the above-identified patent and that said Letters Patent is hereby corrected as shown below:

In column 1, line 9, after "and" insert -- entitled --.

In column 18, line 56, in Claim 11, delete "configure" and insert -- configured --, therefor.

In column 18, line 57, in Claim 11, delete "absence" and insert -- absence of --, therefor.

Signed and Sealed this

Twentieth Day of July, 2010

David J. Kappos

David J. Kappos
*Director of the United States Patent and Trademark Office*